United States Patent [19]

Cassidy

[11] Patent Number: 4,501,388

[45] Date of Patent: Feb. 26, 1985

[54] ANTI-SIFT CARTON

[75] Inventor: Benjamin J. Cassidy, Waldwick, N.J.

[73] Assignee: International Paper Company, New York, N.Y.

[21] Appl. No.: 606,953

[22] Filed: May 4, 1984

[51] Int. Cl.[3] ..... B65D 5/02

[52] U.S. Cl. ..... 229/37 R; 206/807; 229/43

[58] Field of Search ..... 229/37 R, 38, 39 R, 229/43; 206/807

[56] References Cited

U.S. PATENT DOCUMENTS

| | | | |
|---|---|---|---|
| 2,279,358 | 4/1942 | Waters | 229/37 R |
| 2,713,454 | 7/1955 | Nute et al. | 229/37 R |
| 2,874,891 | 2/1959 | Kelsau | 229/37 R |
| 3,040,957 | 6/1962 | Meyers | 229/37 R |

FOREIGN PATENT DOCUMENTS

| | | | |
|---|---|---|---|
| 667641 | 7/1963 | Canada | 229/37 R |

*Primary Examiner*—Joseph Man-Fu Moy
*Attorney, Agent, or Firm*—Richard J. Ancel

[57] ABSTRACT

A paperboard carton has an end structure arranged to prevent sifting out and escape of powdered contents. A first pair of opposed carton panels has opposite major flaps each filling substantially the entire carton end opening and a second pair of opposed panels has opposite minor flaps each of which is divided into first and second minor parts. In the closing sequence, the opposite first minor parts are folded over the carton end, one major flap is next folded over, the opposite second minor parts are folded over, and finally the other major flap is folded over all. One or more flaps may be embossed for better contact and glue is applied to seal the structure.

5 Claims, 6 Drawing Figures

ANTI-SIFT CARTON

BACKGROUND OF THE INVENTION

This invention relates to the end structure for a carton to prevent sifting out and escape of finely divided contents such as flour. The packaging industry has made a considerable effort to improve the sift-proof integrity of its inexpensive paperboard cartons. These are die cut from a one piece blank and formed with a manufacturer's joint into a tube which is shipped flat to the packaging customer and erected and filled and closed by him on appropriate packaging machinery.

One procedure which has been developed in the industry is called the reverse-fold sequence in which the flaps of adjacent front, back and side panels are more or less sequentially folded over to form the end as distinguished from the procedure in which opposite panels are folded at the same time and never sequentially with respect to individual adjacent panels.

The specific procedures which have been developed have their limitations and are subject to constant improvement.

It is accordingly the general object of this invention to provide a sift-proof end structure for a carton which is an improvement over what has previously been done and produced in the art.

SUMMARY OF THE INVENTION

The end structure for the sift-proof carton of the invention has opposite major flaps attached to what may be called the front and back panels, each of which flaps when folded over is capable of substantially filling the entire end opening of the carton. It also has a pair of opposite minor flaps on the opposed side walls each of which is divided into two parts. In forming the end structure the corresponding opposed first parts of such divided minor flaps are first folded over the opening. Then a first major flap is folded and closed over these first two minor parts. Thereafter the second opposite minor parts are closed over the first major flap, and finally the second major flap is closed over all. The flaps may be embossed or offset so as to fit more snugly against each other and glue is applied between them before or during the folding sequence. The edges of some of the flaps are slightly offset in part to provide clearance for the folding of adjacent flaps. In this manner a completely tight end structure is provided.

DETAILED DESCRIPTION

Figure 1:
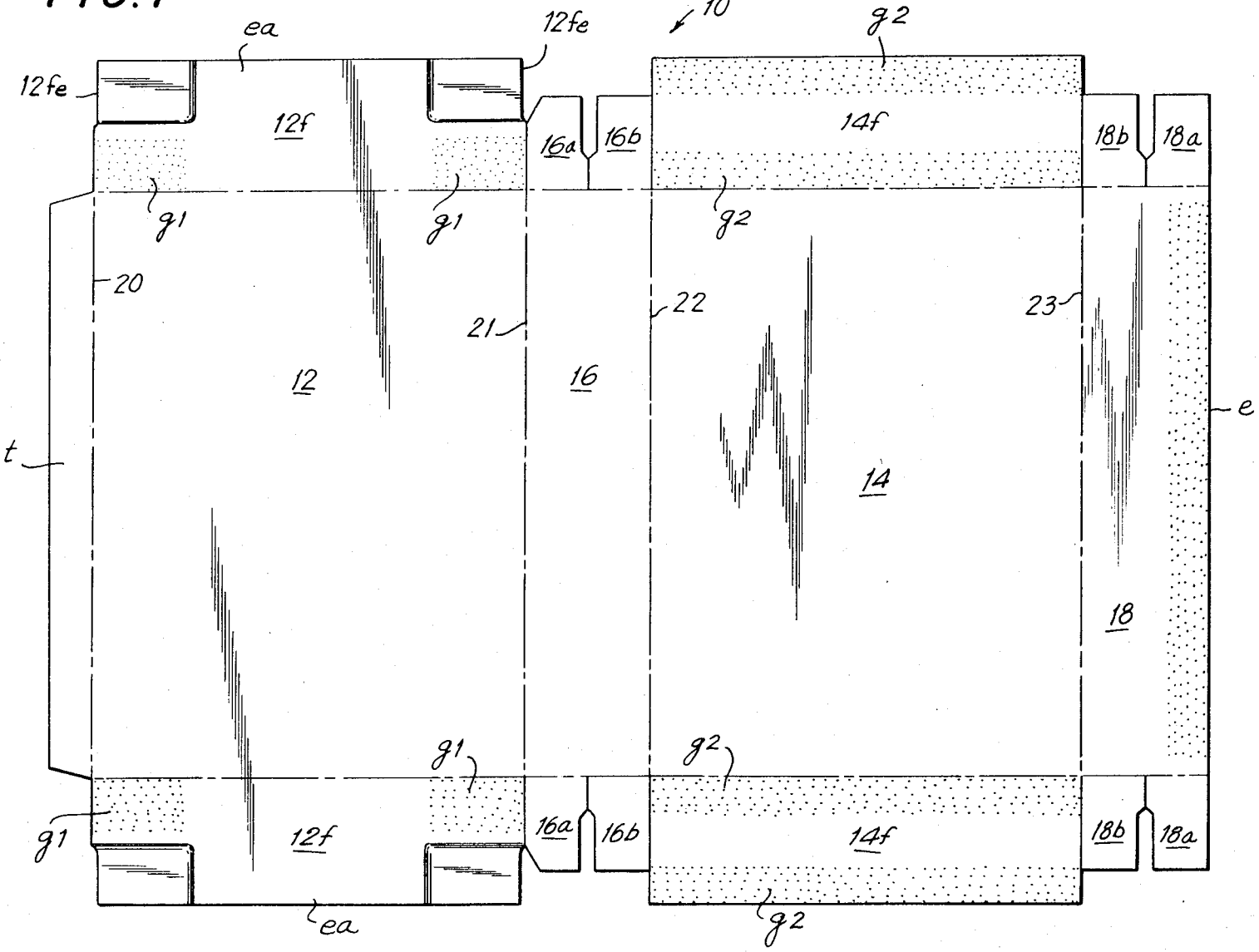
FIG. 1 is a face view of the blank for making the carton which incorporates the invention.

A carton blank is indicated at 10 in FIG. 1 for forming the carton having the anti-sift end structure of the invention. It is formed of single ply paperboard carton stock and when formed into an erected tube its top portion will have the appearance shown in FIG. 2. The bottom portion will be formed in duplicate. The blank 10 and the carton formed from it each has front and back panels 12 and 14 and side panels 16 and 18. The front panel 12 has a glue tab t by which it is joined to the edge e of the side panel 18 when the blank has been folded around fold lines 20, 21, 22 and 23 thereby to form a tube which can be shipped flat by the carton manufacturer to the packager in the usual manner and then erected into a box-like structure as partially seen in FIGS. 2–6.

The front panel 12 has top and bottom major flaps **12*f* and the back panel 14 has top and bottom major flaps 14*f*** each of which can be folded into position to substantially fill an entire carton end opening.

The side panels 16 and 18 have top and bottom minor flaps each of which is divided into first minor parts **16*a* and 18*a* and second minor parts 16*b* and 18*b***, respectively.

None of the bottom flaps are seen in FIGS. 2–6.

Figure 3:
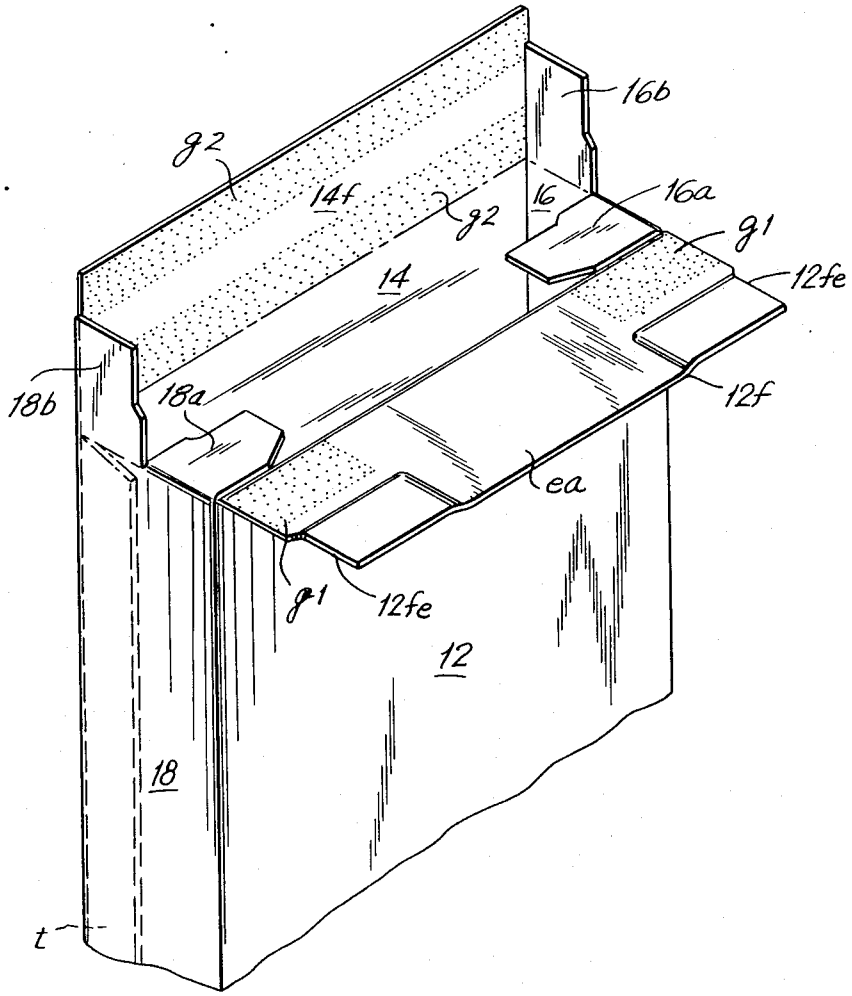
FIG. 3 is a view similar to FIG. 2 but with the first two flap parts folded into closed position.
Figure 2:
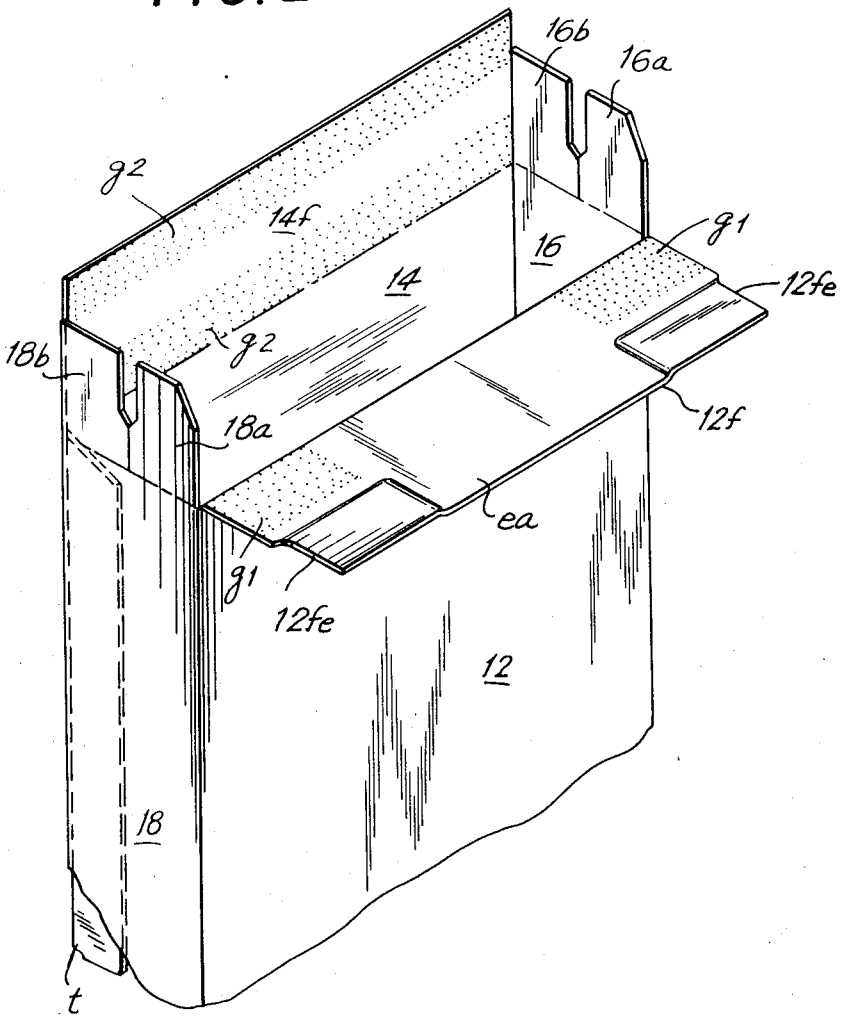
FIG. 2 is a perspective view of the end structure of the invention before the end flaps are folded into closed position.
Figure 4:
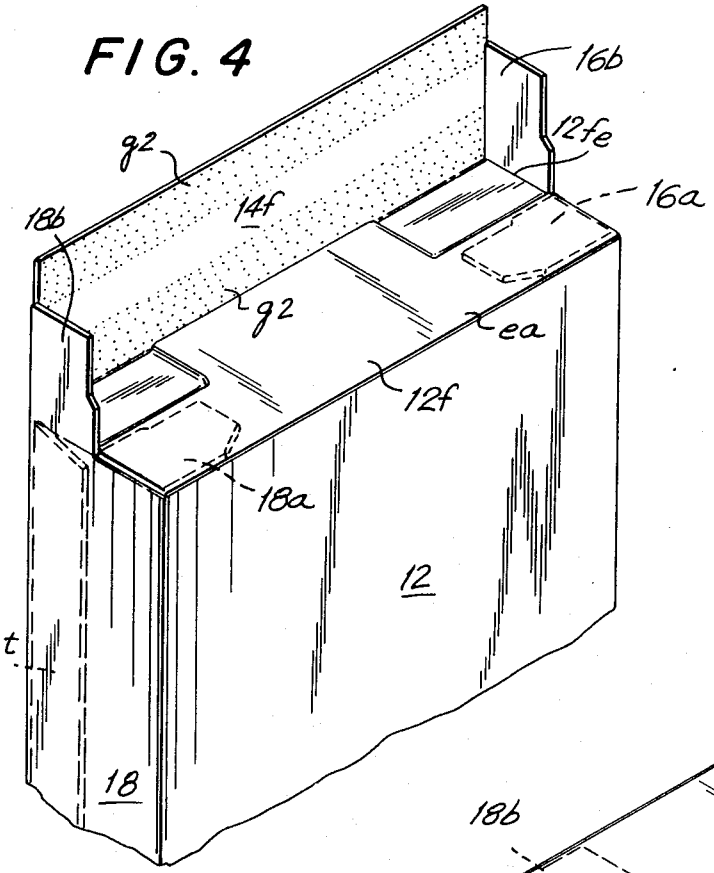
FIG. 4 is a view similar to FIGS. 2 and 3 with the first major flap folded into closed position.

Referring now to FIGS. 2–4, the first minor parts **16*a* and 18*a* of the opposite side panel flaps are first turned down and closed as seen in FIG. 3. Glue is applied to the stippled areas g1 as seen in FIG. 3 on what will be the underside of the adjacent major flap 12*f*. Then this adjacent major flap 12*f* is turned down and closed over the minor flap parts 16*a* and 18*a* as seen in FIG. 4**. Instead of applying glue at this stage, previously applied glue may be activated.

After the flap **12*f* is turned over into closed position the glue areas g1 will cause the flap 12*f* to adhere to the tops of the flap parts 16*a* and 18*a***.

Figure 5:
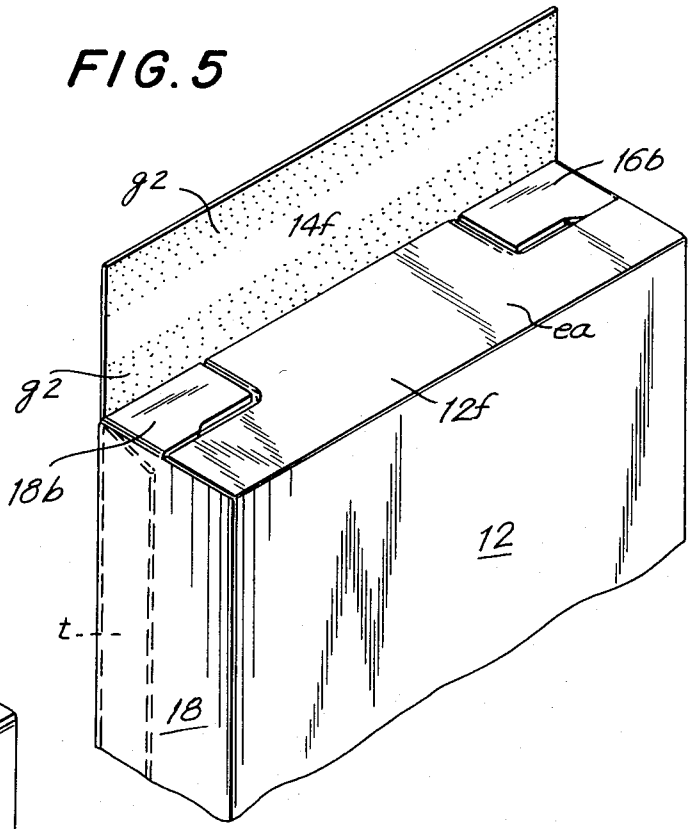
FIG. 5 is a view similar to FIGS. 2–4 with the second pair of flap parts folded into closed position.
Figure 6:
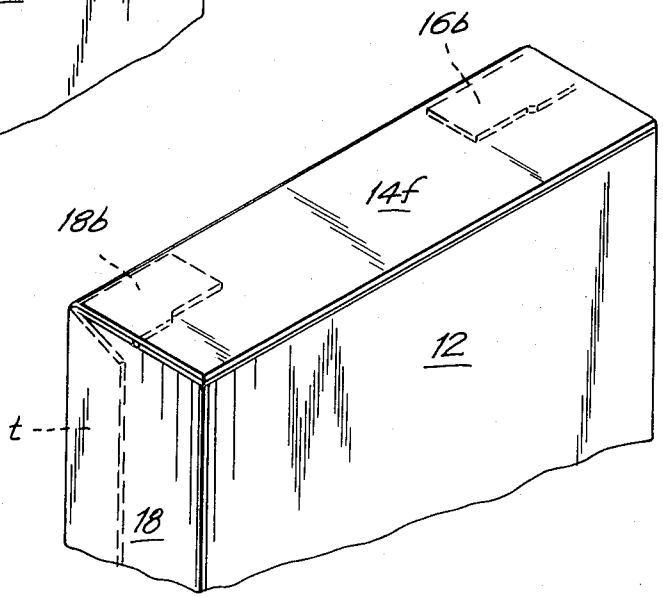
FIG. 6 is a view of the end closure similar to FIGS. 2–5 with the second major flap folded into closed position to complete the end structure of the invention.

In the next step the second minor flap parts **16*b* and 18*b* are turned downwardly into closed position on top of the flap 12*f* as seen in FIG. 5. Then, after glue has been applied, before or during the folding sequence, to what will be the under side of the major flap 14*f* in the stippled areas g2, this major flap 14*f* is turned down and closed over the flap parts 16*b* and 18*b* and the other flaps 16*a*, 18*a* and 12*f* to complete the closure of the end structure as seen in FIG. 6**.

At some point in manufacture the major flap **12*f* is embossed in an area ea. The area ea is shown by shading in FIGS. 1–5. This embossing operation is simply a stamping imposed on the flap 12*f* downwardly as seen in FIGS. 2 and 3 which becomes upwardy as seen in FIGS. 4 and 5 by the thickness of the carton stock. In this manner the area ea is raised upwardly to accommodate the thickness of the minor flap parts 16*a* and 18*a* under it leaving remaining downward portions to accommodate the second minor flap parts 16*b* and 18*b* which are turned down over it. Accordingly, the raised embossed portion ea will be even with the upper surfaces of the second flap parts 16*b* and 18*b* thus presenting a smooth surface to which the major flap 14*f* may be secured when it is turned down as seen in FIG. 6**.

Referring back to FIG. 1 it will be seen that the edges **12*fe* of the major flaps 12*f* (top and bottom) are conveniently offset inwardly by approximately the thickness of the carton stock so that after the major flap 12*f* has been turned down in the closed position as seen in FIG. 4, clearance is provided along the offset portions of the edges 12*fe* to allow the second minor flap parts 16*b* and 18*b*** to be turned down into closed position more conveniently.

It has been found that by means of the novel reverse-fold sequence used in providing the end structure of this invention a sift-proof carton results particularly when both ends are formed in this manner.

While in the embodiment shown and described herein the first major flap to be closed is adjacent to the minor flap parts over which it is closed, it may instead be folded over the other minor flap parts.

While in the embodiment shown and described, the major flap which is first closed over the first minor flap parts to be closed is adjacent to said first minor parts before such major flap and first minor parts are closed, a nonadjacent major flap may instead be closed over the first minor parts to be closed.

What is claimed is:

1. An end structure for an anti-sift carton having opposed front and back panel and opposed side panels, in which the front and back panels have opposite major flaps each filling substantially the entire carton end opening, the side panels have opposite flaps divided into first and second minor parts, said first minor parts being first closed, one of said major flaps being next closed over said first minor parts, said second minor parts being next closed over said one major flap, and the other of said major flaps being finally closed over said second minor parts.

2. An end structure according to claim 1 in which at least one of said flaps is embossed more closely to fit against another of said flaps with which it is in contact.

3. An end structure according to claim 1 in which at least one of said flaps is glued to another flap.

4. An end structure according to claim 1 in which at least one of said flaps has edges slightly offset to provide clearance for other of said flaps in closed position.

5. An end structure according to claim 1 in which the said one major flap which is closed over said first minor flap parts is adjacent to said first minor flap parts before said one major flap and said first minor flap parts are closed.

* * * * *